US008202470B2

(12) United States Patent
Cain et al.

(10) Patent No.: US 8,202,470 B2
(45) Date of Patent: Jun. 19, 2012

(54) LOW $NO_x$ FUEL INJECTION FOR AN INDURATING FURNACE

(75) Inventors: Bruce E. Cain, Akron, OH (US); Thomas F. Robertson, Medina Township, OH (US); John J. Nowakowski, Valley View, OH (US)

(73) Assignee: Fives North American Combustion, Inc., Cleveland, OH (US)

( * ) Notice: Subject to any disclaimer, the term of this patent is extended or adjusted under 35 U.S.C. 154(b) by 79 days.

(21) Appl. No.: 12/729,444

(22) Filed: Mar. 23, 2010

(65) Prior Publication Data

US 2010/0244336 A1 Sep. 30, 2010

Related U.S. Application Data

(60) Provisional application No. 61/162,853, filed on Mar. 24, 2009.

(51) Int. Cl.
*C21B 15/00* (2006.01)

(52) U.S. Cl. ..... 266/44; 266/138; 432/1

(58) Field of Classification Search ..... 266/44, 266/138; 432/1, 105; 431/12, 174, 354
See application file for complete search history.

(56) References Cited

U.S. PATENT DOCUMENTS

| | | | | |
|---|---|---|---|---|
| 3,947,001 | A | 3/1976 | Leighton | |
| 3,998,581 | A | 12/1976 | Hemingway et al. | |
| 4,313,757 | A | 2/1982 | Kiyonoga | |
| 4,503,018 | A | 3/1985 | Gardner et al. | |
| 4,618,323 | A | 10/1986 | Mansour | |
| 4,689,007 | A | 8/1987 | Kilian | |
| 4,945,841 | A | 8/1990 | Nakamachi et al. | |
| 5,201,650 | A | 4/1993 | Johnson | |
| 5,407,345 | A * | 4/1995 | Robertson et al. | 431/115 |
| 5,572,544 | A | 11/1996 | Mathur et al. | |
| 5,630,864 | A | 5/1997 | Rierson | |
| 5,645,410 | A | 7/1997 | Brostmeyer | |
| 5,730,591 | A * | 3/1998 | Robertson et al. | 432/106 |
| 5,823,762 | A | 10/1998 | Anderson et al. | |
| 6,096,261 | A | 8/2000 | Anderson et al. | |
| 6,116,896 | A | 9/2000 | Joshi et al. | |
| 6,125,133 | A | 9/2000 | Mathur et al. | |
| 6,221,127 | B1 | 4/2001 | Rierson | |
| 6,238,206 | B1 * | 5/2001 | Cummings et al. | 431/181 |
| 6,400,747 | B1 | 6/2002 | Mathur | |
| 6,638,061 | B1 | 10/2003 | Cain et al. | |
| 6,705,855 | B2 | 3/2004 | Nagayama et al. | |
| 6,773,256 | B2 | 8/2004 | Joshi et al. | |

(Continued)

OTHER PUBLICATIONS

Cain et al., "Reducing NOx Emissions in High-Temperature Furnaces", The North American Manufacturing Company, USA (undated), 18 pages.

(Continued)

*Primary Examiner* — Roy King
*Assistant Examiner* — Michael Aboagye
(74) *Attorney, Agent, or Firm* — Jones Day

(57) ABSTRACT

An indurating furnace has a heating station and an air passage leading to the heating station. A draft of preheated recirculation air is driven through the passage toward the heating station, and is mixed with fuel gas to form a combustible mixture of preheated recirculation air and fuel gas that ignites in the passage. This is accomplished by injecting the fuel gas into the passage in a stream that does not form a combustible mixture with the preheated recirculation air before entering the passage.

23 Claims, 15 Drawing Sheets

U.S. PATENT DOCUMENTS

| | | | | |
|---|---|---|---|---|
| 7,104,784 | B1 * | 9/2006 | Hasegawa et al. | 431/4 |
| 7,402,038 | B2 | 7/2008 | Neville et al. | |
| 7,824,179 | B2 * | 11/2010 | Hasegawa et al. | 431/215 |
| 2007/0062197 | A1 | 3/2007 | Hannum et al. | |

OTHER PUBLICATIONS

Robertson, et al., "Application of a Novel Low NOx Combustion System to an Oil Field Stream Generator", Society of Petroleum Engineers, SPE 30266, 1995, 16 pages.

Specification and Drawings from Copending U.S. Appl. No. 12/552,515, filed Sep. 2, 2009, entitled, "NOx Suppression Techniques for an Indurating Furnace", 25 pages.

Specification and Drawings from Copending U.S. Appl. No. 12/124,454, filed May 21, 2008, entitled, "Combustion Method and Apparatus", 20 pages.

Office Action for U.S. Appl. No. 12/124,454, filed May 21, 2008, entitled, "Combustion Method and Apparatus", 11 pages.

* cited by examiner

LOW $NO_x$ FUEL INJECTION FOR AN INDURATING FURNACE

This application claims the benefit of provisional U.S. patent application 61/162,853, filed Mar. 24, 2009, which is incorporated by reference.

TECHNICAL FIELD

This technology relates to a heating system in which combustion produces oxides of nitrogen ($NO_x$), and specifically relates to a method and apparatus for suppressing the production of $NO_x$ in an indurating furnace.

BACKGROUND

Certain industrial processes, such as heating a load in a furnace, rely on heat produced by the combustion of fuel and oxidant. The fuel is typically natural gas. The oxidant is typically air, vitiated air, oxygen, or air enriched with oxygen. Combustion of the fuel and oxidant causes $NO_x$ to result from the combination of oxygen and nitrogen.

An indurating furnace is a particular type of furnace that is known to produce high levels of $NO_x$. Large quantities of pelletized material, such as pellets of iron ore, are advanced through an indurating process in which they are dried, heated to an elevated temperature, and then cooled. The elevated temperature induces an oxidizing reaction that hardens the material. When cooled, the indurated pellets are better able to withstand subsequent handling in storage and transportation.

The indurating furnace has sequential stations for the drying, heating, and cooling steps. Pelletized material is conveyed into the furnace, through the sequential stations, and outward from the furnace. Air shafts known as downcomers deliver downdrafts of preheated air to the heating stations. Burners at the downdrafts provide heat for the reaction that hardens the pelletized material.

An example of a pelletizing plant 10 with an indurating furnace 20 is shown schematically in FIG. 1. A movable grate 24 conveys loads of pelletized material 26 into the furnace 20, through various processing stations within the furnace 20, and then outward from the furnace 20. The processing stations include drying, heating, and cooling stations. In this particular example, the drying stations include an updraft drying station 30 and a downdraft drying station 32. The heating stations include preheat stations 34 and firing stations 36. First and second cooling stations 38 and 40 are located between the firing stations 36 and the furnace exit 42. Burners 44 are arranged at the preheating and firing stations 34 and 36.

A blower system 50 drives air to circulate through the furnace 20 along the flow paths indicated by the arrows shown in FIG. 1. As the pelletized material 26 advances from the firing stations 36 toward the exit 42, it is cooled by the incoming air at the first and second cooling stations 38 and 40. This causes the incoming air to become heated before it reaches the burners 44. The preheated air at the second cooling station 40 is directed through a duct system 52 to the updraft drying station 30 to begin drying the material 26 entering the furnace 20. The preheated air at the first cooling station 38, which is hotter, is directed to the firing and preheat stations 36 and 34 through a header 54 and downcomers 56 that descend from the header 54. Some of that preheated air, along with products of combustion from the firing stations 36, is circulated through the downdraft drying station 32 before passing through a gas cleaning station 58 and onward to an exhaust stack 60.

As shown for example in FIG. 2, each downcomer 54 defines a vertical passage 61 for directing a downdraft 63 from the header 52 to an adjacent heating station 36. Each burner 44 is arranged to project a flame 65 into a downcomer 54. Specifically, each burner 44 is mounted on a downcomer wall 66 in a position to project the flame 65 in a direction extending across the vertical passage 61 toward the heating station 36 to provide heat for the reaction that hardens the pelletized material 26.

The burner 44 of FIG. 2 is an inspirating burner, which injects fuel and combustion air. The combustion air includes unheated air from the blower assembly 50 and preheated air that is drawn from the downdraft 63 through an inspirator 68. The fuel and combustion air are typically injected at a fuel-rich ratio. This produces high levels of interaction $NO_x$ as the unmixed or poorly mixed fuel interacts with the high temperature downdraft air.

SUMMARY OF THE INVENTION

An indurating furnace has a heating station and an air passage leading to the heating station. A draft of preheated recirculation air is driven through the passage toward the heating station, and is mixed with fuel gas to form a combustible mixture that ignites in the passage. This is accomplished by injecting the fuel gas into the passage in a stream that does not form a combustible mixture with the preheated recirculation air before entering the passage.

DETAILED DESCRIPTION

Figure 1:
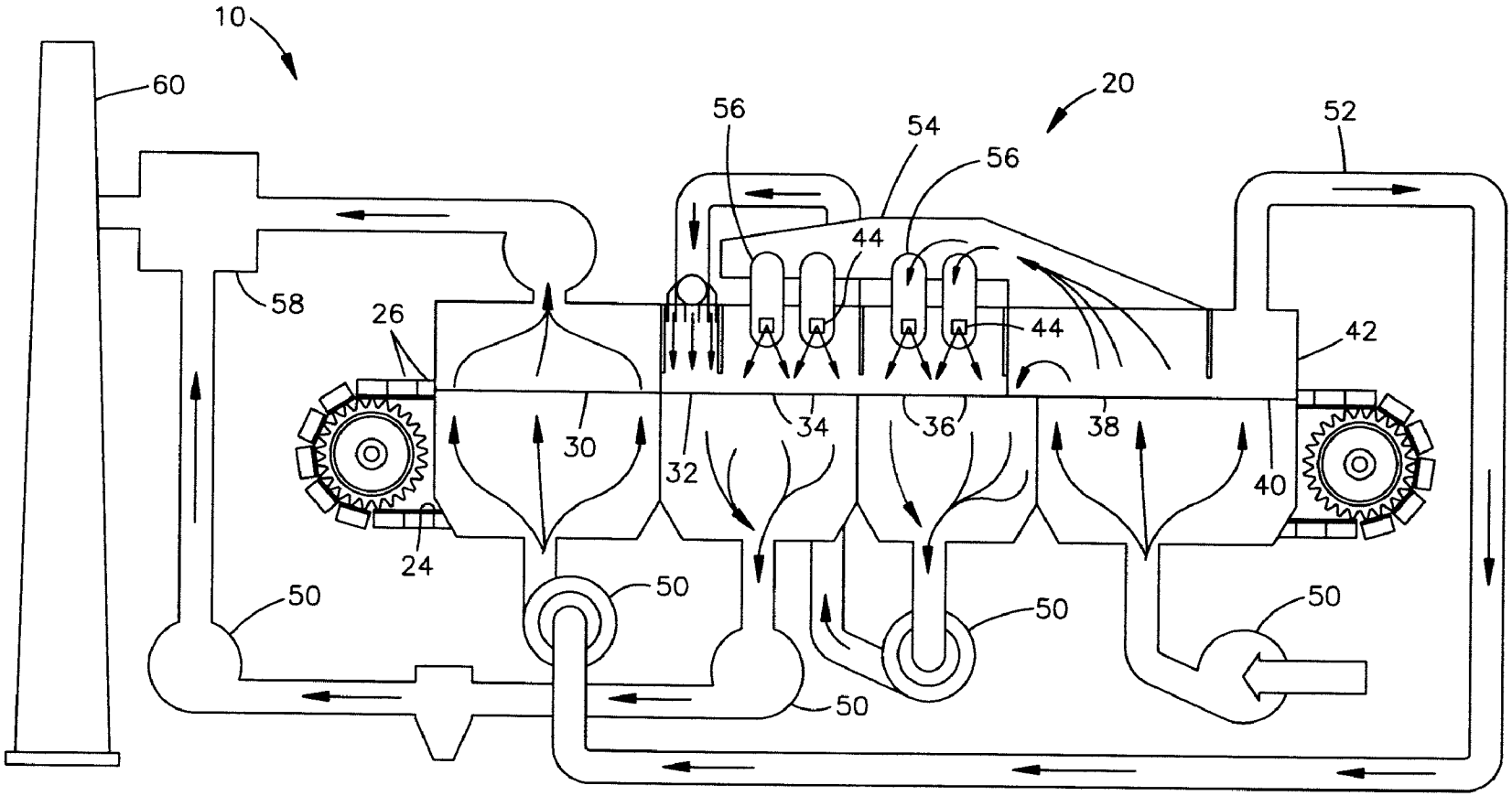
Fig.1 PRIOR ART
FIG. 1 is a schematic view of a pelletizing plant including an indurating furnace known in the prior art.
Figure 2:
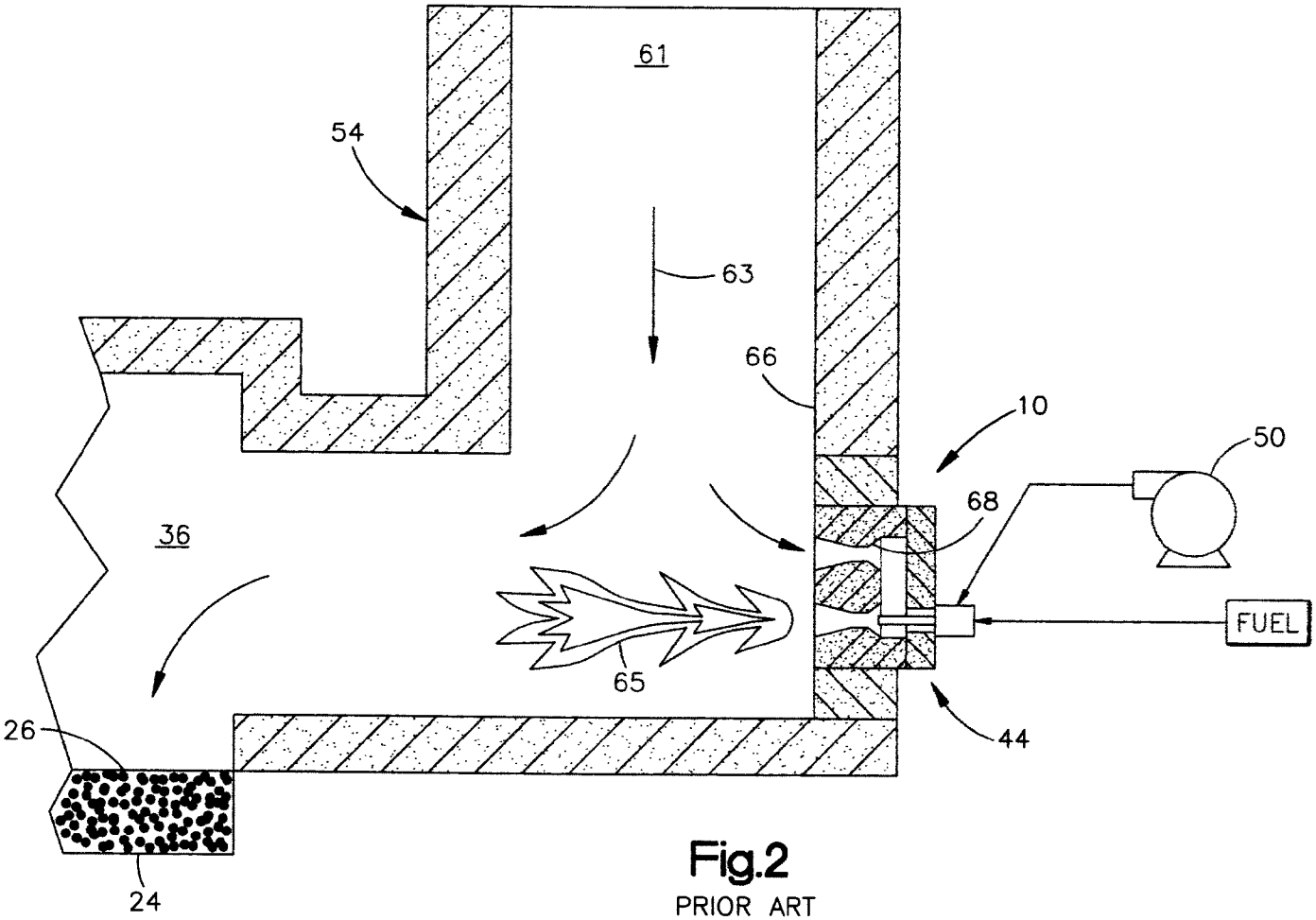
Fig.2 PRIOR ART
FIG. 2 is an enlarged partial view of parts of the prior art indurating furnace of FIG. 1.
Figure 3:
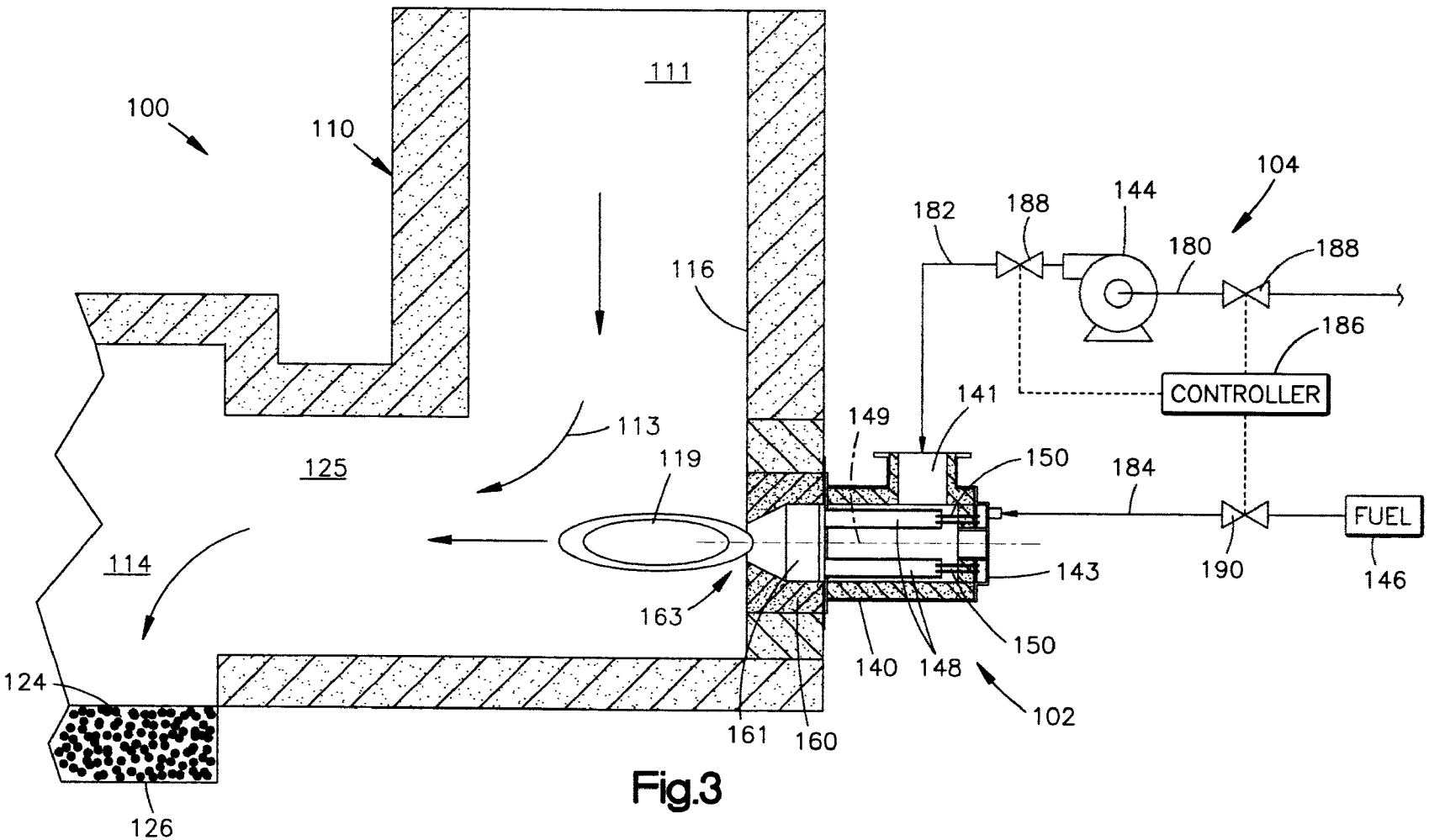
FIGS. 3 and 4 are schematic views similar to FIG. 2, but show embodiments of an indurating furnace that are not known in the prior art.

As shown partially in FIG. 3, an indurating furnace 100 is equipped with burners 102, one of which is shown in the drawing. The furnace 100 also has a reactant supply and control system 104 for operating the burners 102. The furnace 100 is thus configured according to the invention disclosed and claimed in copending U.S. patent application Ser. No. 12/555,515, filed Sep. 2, 2009, which is commonly owned by the Assignee of the present application. The furnace 100 may otherwise be the same as the furnace 20 described above, with downcomers 110 defining vertical passages 111 for directing downdrafts 113 from a header to adjacent heating stations 114. As set forth in the copending application, each burner 102 is mounted on a corresponding downcomer wall 116 in a position to project a premix flame 119 into the downdraft 113 in a direction toward the heating station 114. This provides heat for a reaction that hardens pelletized material 124 on a movable grate 126 at the heating station 114.

In the illustrated embodiment, the flame 119 is projected across the downcomer 110 toward a horizontal lower end section 125 of the vertical passage 111 that terminates adjacent to the heating station 114. Although the illustrated downcomer 110 has a predominantly vertical passage 111, any suitable arrangement or combination of differently oriented passages for conveying a preheated recirculation air draft to an indurating heating station may be utilized.

The burners 102 are preferably configured as premix burners with the structure shown in the drawing. This burner structure has a rear portion 140 defining an oxidant plenum 141 and a fuel plenum 143. The oxidant plenum 141 receives a stream of unheated atmospheric air from a blower system 144. The fuel plenum 143 receives a stream of fuel from the plant supply of natural gas 146.

Mixer tubes 148 are located within the oxidant plenum 141. The mixer tubes 148 are preferably arranged in a circular array centered on a longitudinal axis 149. Each mixer tube 148 has an open inner end that receives a stream of combustion air directly from within the oxidant plenum 141. Each mixer tube 148 also receives streams of fuel from fuel conduits 150 that extend from the fuel plenum 143 into the mixer tube 148. These streams of fuel and combustion air flow through the mixer tubes 148 to form a combustible mixture known as premix.

An outer portion 160 of the burner 102 defines a reaction zone 161 with an outlet port 163. The premix is ignited in the reaction zone 161 upon emerging from the open outer ends of the mixer tubes 148. Ignition is initially accomplished by use of an igniter before the reaction zone 161 reaches the auto-ignition temperature of the premix. Combustion proceeds as the premix is injected from the outlet port 163 into the downcomer 110 to mix with the downdraft 113. The fuel in the premix is then burned in a combustible mixture with both premix air and downdraft air. By mixing the fuel with combustion air to form premix, the burner 102 avoids the production of interaction $NO_x$ that would occur if the fuel were unmixed or only partially mixed with combustion air before mixing into the downdraft air.

As further shown in FIG. 3, the reactant supply and control system 104 includes a duct 180 through which the blower system 144 receives unheated air from the ambient atmosphere. Another duct 182 extends from the blower system 144 to the oxidant plenum 141 at the burner 102. A fuel line 184 communicates the fuel source 146 with the fuel plenum 143 at the burner 102. Other parts of the system 104 include a controller 186, oxidant control valves 188, and fuel control valves 190.

The controller 186 has hardware and/or software that is configured for operation of the burner 102, and may comprise any suitable programmable logic controller or other controlled device, or combination of controlled devices, that is programmed or otherwise configured to perform as described and claimed. As the controller 186 carries out those instructions, it operates the valves 188 and 190 to initiate, regulate, and terminate flows of reactant streams that cause the burner 102 to fire the premix flame 119 into the downcomer 110. The controller 186 is preferably configured to operate the valves 188 and 190 such that the fuel and combustion air are delivered to the burner 102 in amounts that form premix having a lean fuel-to-oxidant ratio. The fuel-lean composition of the premix helps to avoid the production of interaction $NO_x$ in the downdraft 113.

Figure 4:
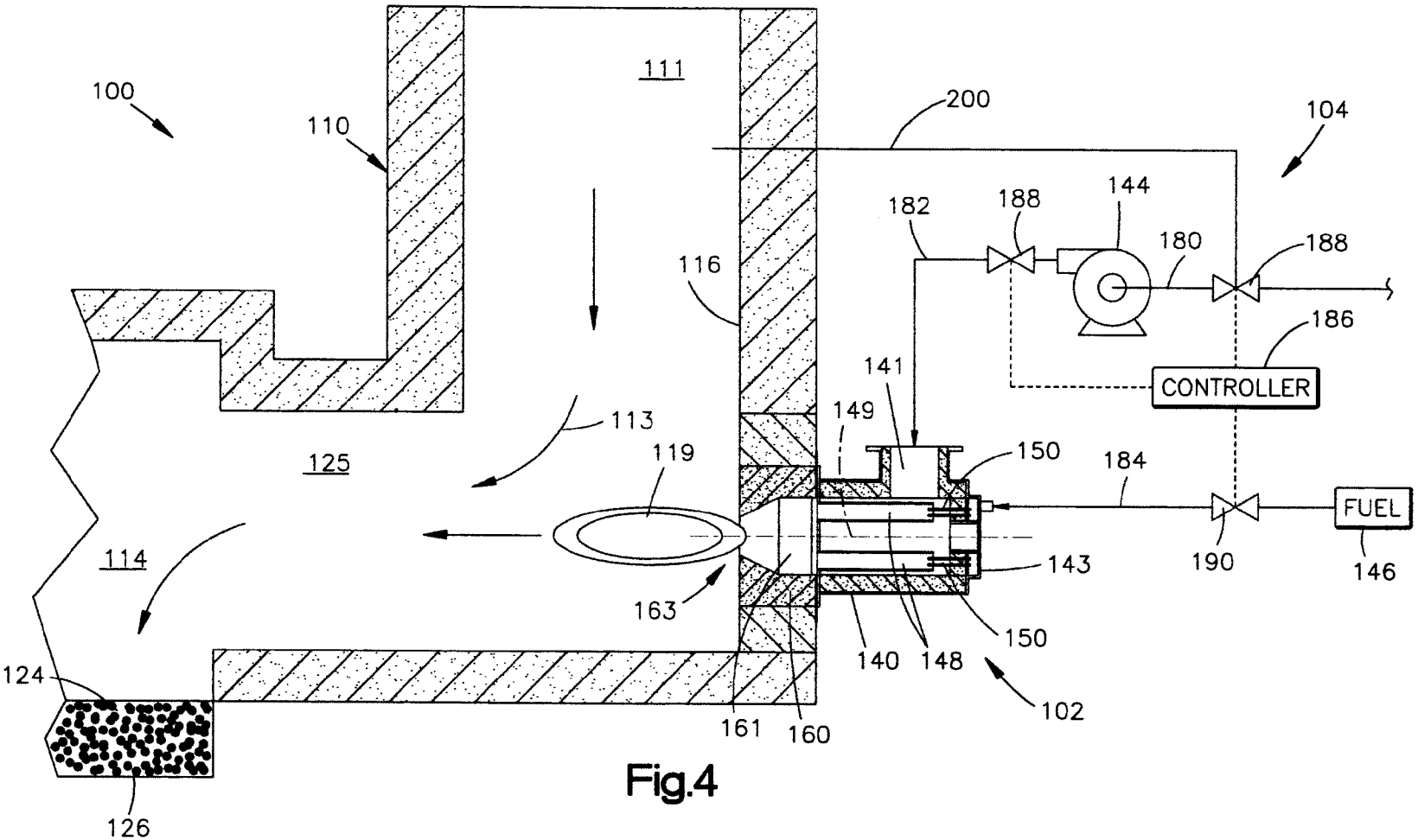

Although the premix produces less interaction $NO_x$ upon combustion of the fuel-air mixture in the high temperature downdraft 113, this has an efficiency penalty because it requires more fuel to heat the cold atmospheric air in the premix. The efficiency penalty is greater if the premix has excess air to establish a lean fuel-to-oxidant ratio. However, the efficiency penalty can be reduced or avoided by using an embodiment of the invention that includes preheated air in the premix. For example, in the embodiment shown in FIG. 4, the reactant supply and control system 104 includes a duct 200 for supplying the burner 102 with preheated downdraft air from the downcomer 110. As in the embodiment of FIG. 3, the controller 186 in the embodiment of FIG. 4 is preferably configured to operate the valves 188 and 190 such that the fuel gas, the unheated air, and the preheated air are delivered to the burner 102 in amounts that form premix having a lean fuel-to-oxidant ratio.

Figure 5:
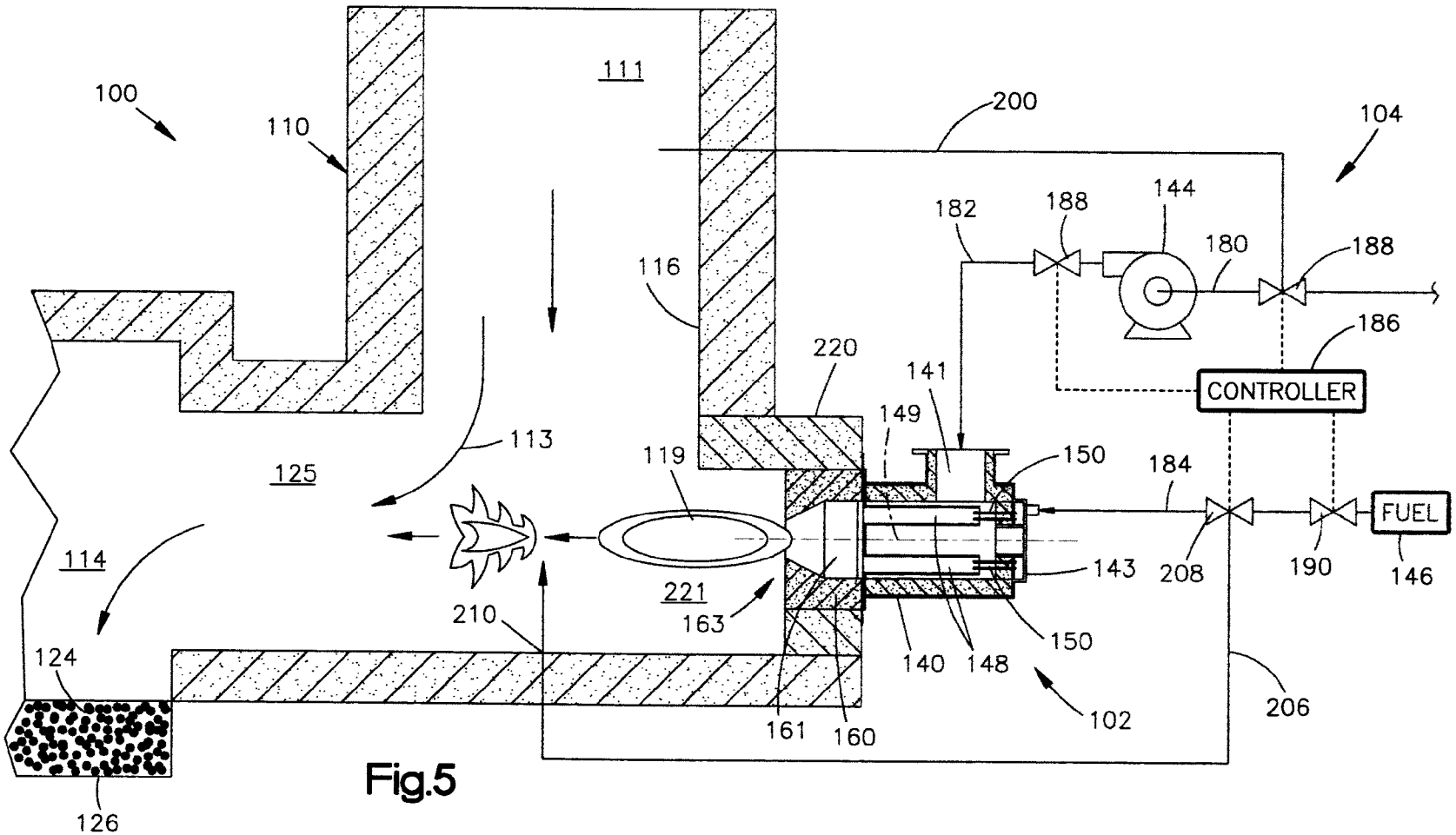
FIGS. 5-9 are similar to FIGS. 3 and 4, showing alternative embodiments of an indurating furnace with elements of the present invention.

The embodiment of FIG. 5 also reduces the efficiency penalty caused by the premix in the embodiment of FIG. 3. In this embodiment, the reactant supply and control system 104 includes a fuel branch line 206 with a control valve 208. As shown schematically, the branch line 206 terminates at a fuel injection port 210 that is spaced axially downstream from the burner 102. The reactant supply and control system 104 is thus configured to supply primary fuel gas and combustion air to the premix burner 102, and to separately inject second stage fuel gas into the downcomer 110 without combustion air. The controller 186 is preferably configured to operate the valves 188, 190 and 208 such that primary fuel and combustion air are delivered to the burner 102 in amounts that form premix having a lean fuel-to-oxidant ratio, while simultaneously providing the branch line 206 with second stage fuel in an amount that is stoichiometric with the premix supplied to the burner 102. Since the premix in this embodiment includes less than the total target rate of fuel, it can include a correspondingly lesser amount of unheated air to establish a lean fuel-to-oxidant ratio. The lesser amount of unheated air in the premix causes a lower efficiency penalty.

An additional $NO_x$ suppression feature of the invention appears in FIG. 5 where the downcomer 110 is shown to have a recessed wall portion 220. This portion 220 of the downcomer 110 defines a combustion zone 221 that is recessed from the vertical passage 111. The burner 102 is mounted on the recessed wall portion 220 of the downcomer 110 so as to inject premix directly into the combustion zone 221 rather than directly into the vertical passage 111.

Figure 6:
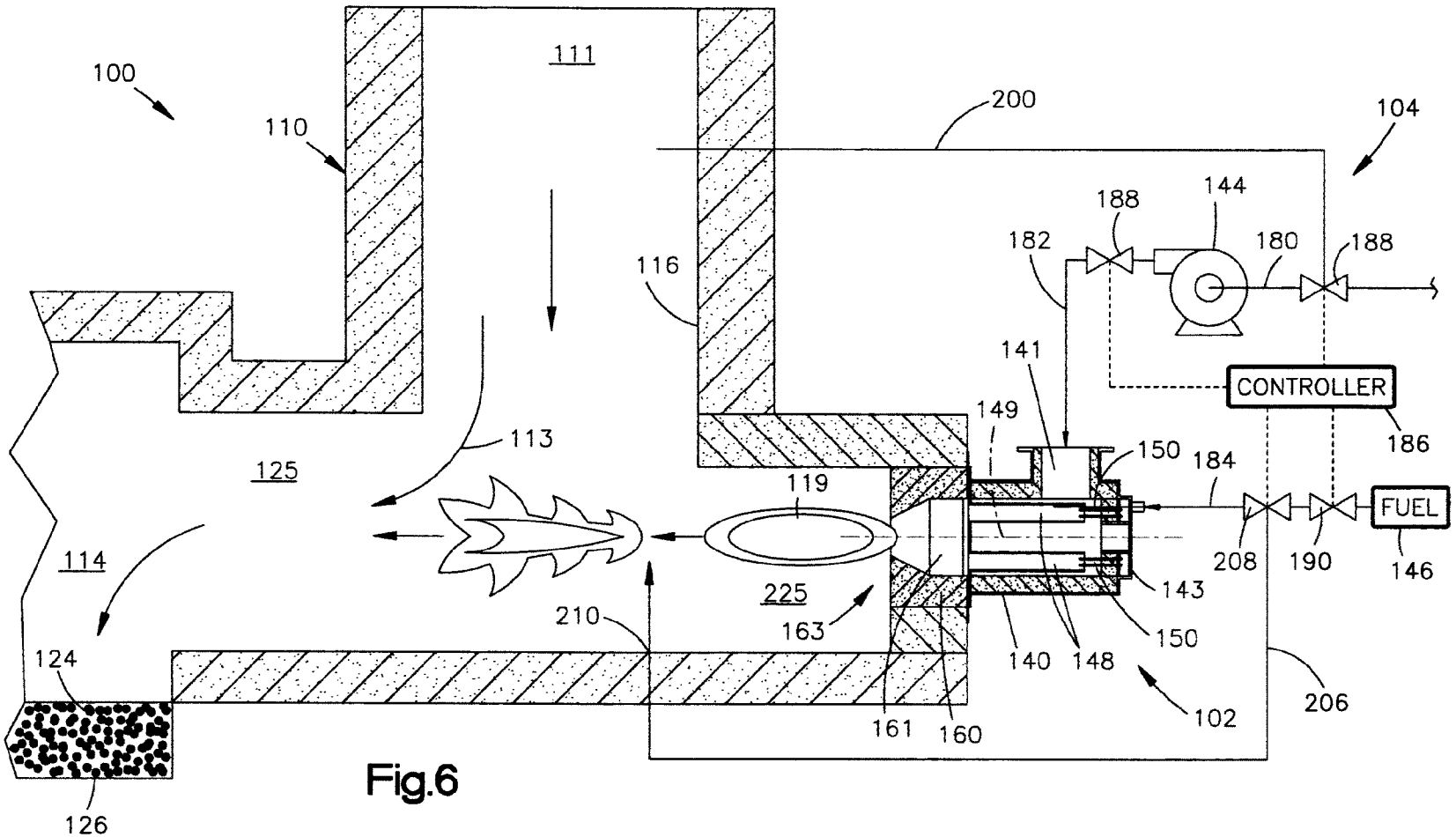

In the embodiment of FIG. 5, the premix flame 119 projects fully through the combustion zone 221 and into the vertical passage 111. The controller 186 could provide the burner 102 with fuel and combustion air at lower flow rates to cause the premix flame 119 to project only partially through the combustion zone 221 and thereby to produce less interaction $NO_x$ in the vertical passage 111. As shown in FIG. 6, a deeper combustion zone 225 could have the same effect without reducing the reactant flow rates.

Figure 7:
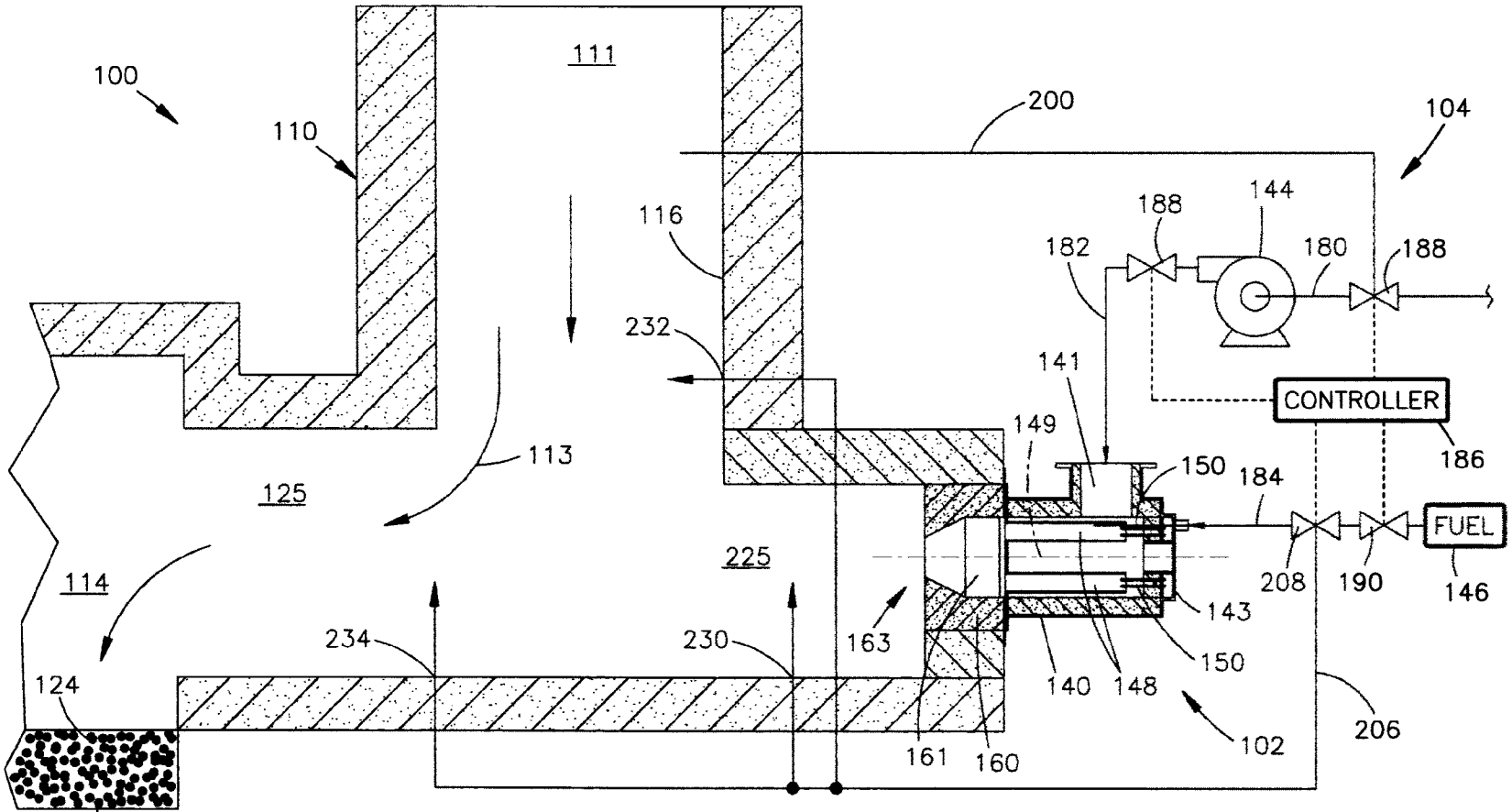

Additional suppression of interaction $NO_x$ can be achieved with differently staged fuel injection ports along with a recessed combustion zone. As shown for example in FIG. 7, these may include a port 230 for injecting staged fuel directly into the recessed combustion zone 225, a port 232 for injecting staged fuel directly into the vertical passage 111 upstream of the recessed combustion zone 225, and a port 234 for injecting staged fuel into the vertical passage 111 at a location downstream of the recessed combustion zone 225.

Figure 8:
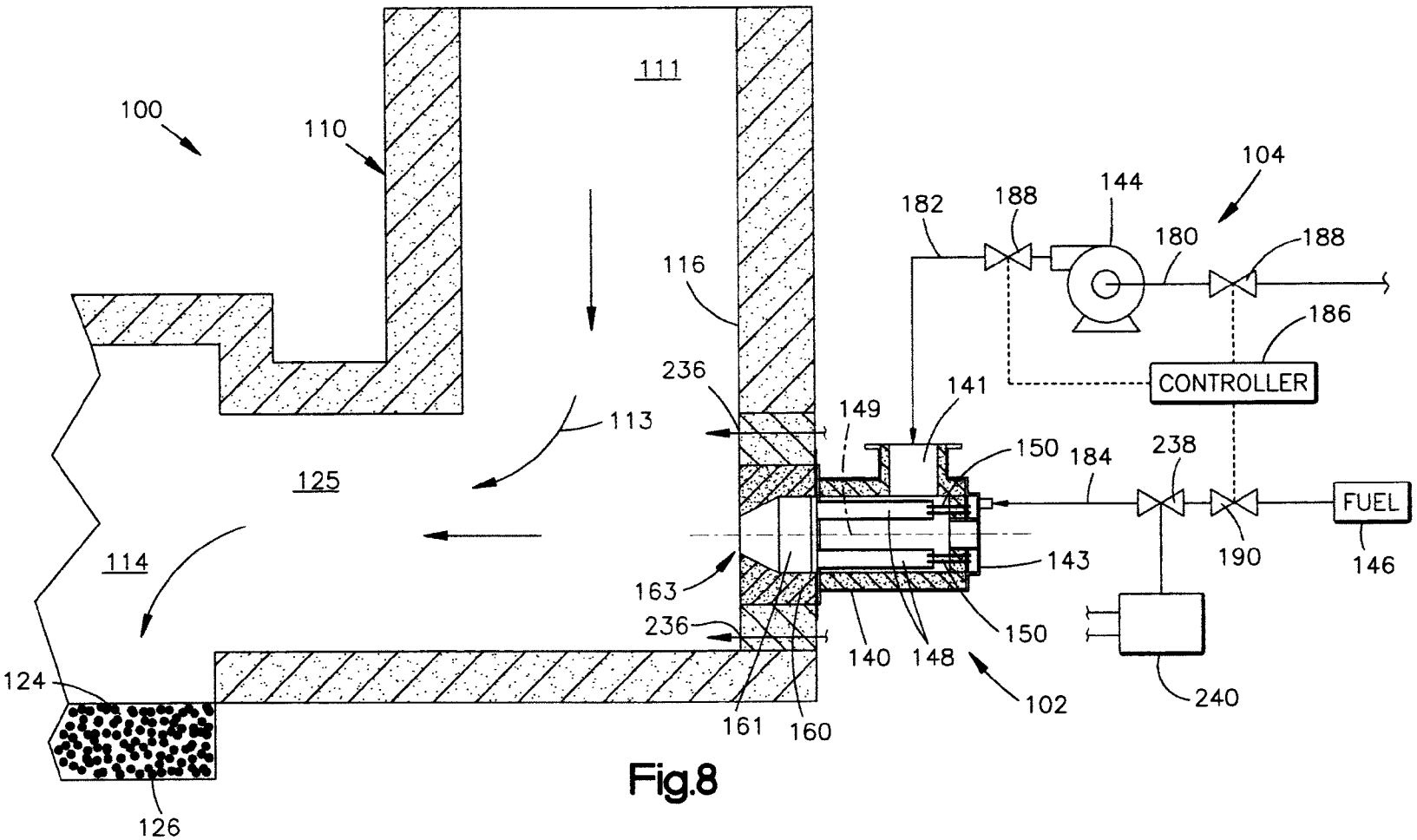

The embodiment of FIG. 8 has another alternative arrangement of staged fuel injector ports 236. These ports 236 are all arranged on the downcomer wall 116 in positions spaced radially from the burner port 163, and are preferably arranged in a circular array centered on the burner axis 149. The reactant supply and control system 104 includes a staged fuel control valve 238 for diverting fuel to a manifold 240 that distributes the diverted fuel to each port 236 equally. The ports 236 together inject that fuel into the downcomer 110 in a circular array of second stage streams. The ports 236 may be configured to inject the second stage fuel streams in directions that are parallel to and/or inclined toward the axis 149.

Figure 9:
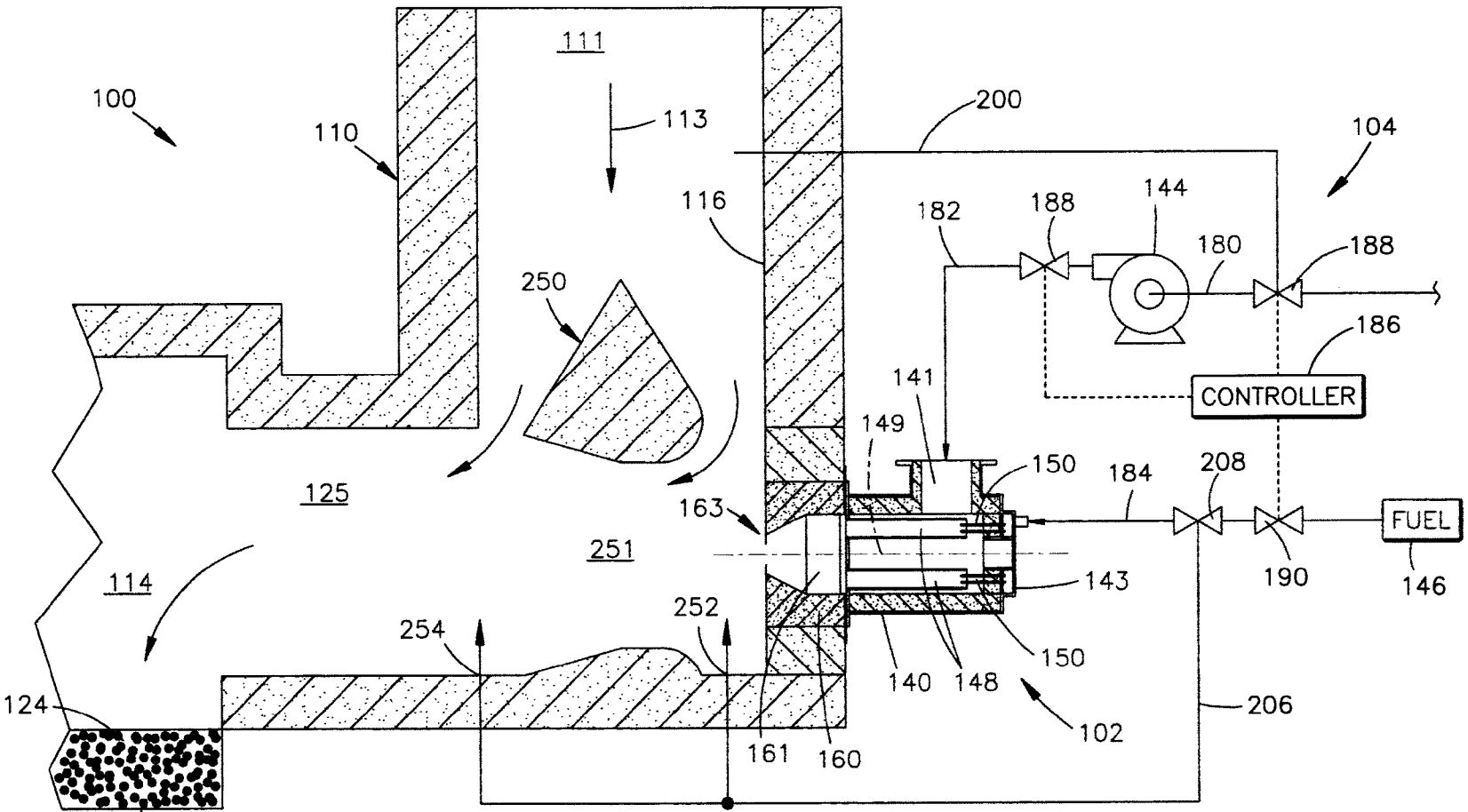

In the embodiment of FIG. 9, the downcomer 110 is equipped with a Venturi mixer structure 250. The Venturi mixture structure 250 has a mixer flow passage 251, and is arranged within the vertical downcomer passage 111 such that the mixer flow passage 251 is aligned with the burner port 163. The reactant supply and control system 104 has a staged fuel injector port 252 for injecting second stage fuel without combustion air at a location upstream of the Venturi mixture structure 250. It also has a staged fuel injector port 254 for injecting third stage fuel without combustion air at a location downstream of the Venturi mixer structure 250. In this arrangement, the premix injected from the burner port 163 entrains both downdraft air and second stage fuel into the mixer flow passage 251. This promotes thorough mixing of those reactants fig uniform combustion, and helps to suppress the peak flame temperature to suppress the production of $NO_x$. Fuel efficiency can be improved by providing the staged fuel in an amount that is stoichiometric with the premix.

The temperature of the preheated air in the downdraft 113 is typically expected to be in the range of 1,500 to 2,000 degrees F., which is above the auto-ignition temperature of the fuel gas. For natural gas, the auto-ignition temperature is typically in the range of 1,000 to 1,200 degrees F. Therefore, in the embodiments of FIGS. 4-7 and 9, which use preheated downdraft air along with ambient air to form premix with the fuel gas, the downdraft air is mixed with the ambient air before being mixed with the fuel gas. This cools the downdraft air to a temperature below the auto-ignition temperature to prevent the fuel from igniting inside the mixer tubes 146 before the premix enters the downcomer 110.

Generally, in the case of a premix flame, the temperature and air-to-fuel ratio are both more uniform, which produces less $NO_x$. Also, if the peak flame temperature (or peak reaction temperature) is maintained at or below 2,800 degrees F., $NO_x$ production will be less than if the flame were hotter. The excess air in fuel-lean premix can thus inhibit the production of $NO_x$ by absorbing heat to keep the peak flame temperature from exceeding 2,800 degrees F. For ambient temperature air, in order to maintain the peak flame temperature at or below 2,800 degrees F., the premix air-to-fuel ratio should have at least 45% more air than the stoichiometric amount, i.e. 45% excess air. If the excess air approaches 80%, the peak flame temperature is likely to fall below 2,500 degrees F., and the flame could become unstable at the lower temperature. Accordingly, for a premix of natural gas and air at ambient temperature, the air-to-fuel ratio should include excess air in the range of 45%-80%, and preferably in the range of 50%-70%.

In the case of combustion with preheated air, the high temperature of the air requires the air-to-fuel ratio to include a greater amount of excess air to keep the peak flame temperature from exceeding 2,800 degrees F. For example, preheated air of 500 degrees requires 75%-100% excess air; preheated air of 1000 degrees F. requires 100%-150% excess air; preheated air of 1,500 degrees F. requires 200%-300% excess air; and preheated air of 2,000 degrees F. requires 400%-600% excess air for combustion with a peak flame temperature of 2,800 degrees F. or less.

The pelletizing process typically requires temperatures approaching 2,400-2,500 degrees F. These processing temperatures at the heating stations 114 could be provided by combustion with peak flame temperatures of 2,500-2,800 degrees F. in the adjacent downcomers 110. These peak flame temperatures could be maintained by combustion of natural gas and preheated air of 1,500-2,000 degrees F. and 200%-600% excess air. Preheated air of that temperature and amount is available in the downdrafts 113. However, since the downdraft air temperature of 1,500-2,000 degrees F. is higher than the auto-ignition temperature, the downdraft air can not form an unignited premix in the burners 102 if it is not first mixed with cooler air as noted above regarding FIGS. 4-7 and 9.

Even though the elevated temperature of the preheated downdraft air is greater than the auto-ignition temperature, the present invention can utilize the preheated downdraft air to approach or attain the low $NO_x$, lean combustion conditions described above with reference to premix. This is accomplished by injecting fuel gas into the downcomer 110 in one or more streams that do not form a combustible mixture with the preheated downdraft air before entering the downcomer 110. When the injected fuel mixes with the preheated downcomer air, those reactants form a combustible mixture that ignites in the downcomer 110. This results in combustion conditions that can approach or attain the conditions of low $NO_x$ lean premix combustion, including the preferred conditions of 200%-400% excess air at 1,500-2,000 degrees F. with a peak flame temperature of 2,500-2,800 degrees F.

This feature of the invention is accomplished to a limited extent in the embodiments of FIGS. 5-9. In those embodiments, streams consisting of fuel gas are injected from the fuel injection ports 210, 230, 232, 234, 236, 252 and 254 into the downcomer 110 without flame stabilization. There is a very slight delay (milliseconds) between the time that fuel is injected into a high temperature oxidant stream and the time it ignites. If the fuel injected from the ports 210, 232-236 and 252-254 mixes rapidly with the preheated downdraft air, the resulting combustion can, at least in part, approach or attain the preferred premix-like conditions of uniformity, excess air, and temperature.

Several techniques can promote more rapid mixing of the fuel gas and preheated air in the downcomer 110. For example, fuel injection at very high pressure and/or velocity, such as from a pressure recovering nozzle, can cause correspondingly high entrainment of the downdraft 113 into the stream of injected fuel gas. A pressure of 15 psi or more would be preferred. A small amount of diluent in the stream can increase the ignition delay by supplying thermal ballast fuel, and can also provide additional momentum to speed up the mixing. Suitable diluents include air, steam, and recirculated exhaust, among others.

Even if mixing is not rapid enough to result in a peak flame temperature at or below 2,800 degrees F. upon ignition in the downcomer 110, $NO_x$ can be suppressed by quickly reducing the temperature to the target level. This can be accomplished by very high velocity injection of the fuel; dividing the fuel in to multiple, discrete small streams that are injected at separate points; spacing the streams apart from each other; and making the individual streams small enough to react completely before mixing with or encountering uncombusted fuel from another stream. Additionally, if some of the individual fuel streams are injected downstream of other fuel streams, the fuel injected upstream may have already reacted and had its heat dissipated, and will vitiate the preheated downcomer air (to slightly reduce its oxygen content) for the fuel injected downstream.

Figure 10:
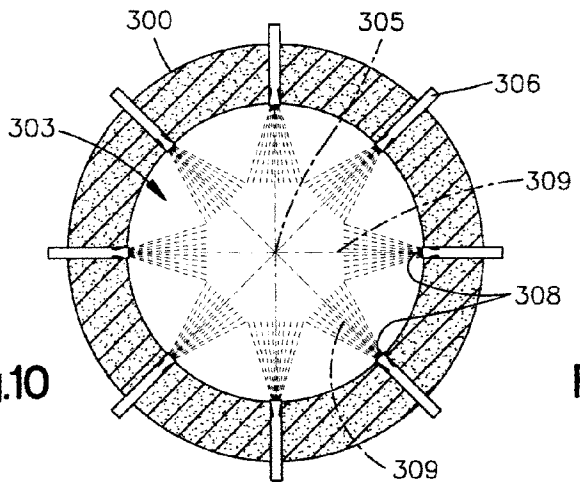

The foregoing techniques are employed in various combinations in the embodiments of the invention shown in FIGS. 10-22. In FIG. 10, an indurating furnace wall structure 300, which may be a downcomer, defines a passage 303 for conveying a draft of preheated recirculation air to a heating station in the indurating furnace. The wall structure 300 in this example is circular with a central axis 305. Fuel injectors 306 with nozzles 308 are mounted on the wall structure 300. The apparatus of FIG. 10 is thus configured to mix the preheated recirculation air draft with fuel gas, and thereby to form a combustible mixture of preheated recirculation air and fuel gas that ignites in the passage 303, by injecting fuel gas into the passage 303 in multiple streams that do not form combustible mixtures before entering the passage 303. Ideally, the amount of fuel in each individual stream will not be more than can be fully combusted before intersecting the reaction zones from any of the other fuel streams.

As in the embodiments of FIGS. 3-9, each embodiment of FIGS. 10-22 is equipped with a reactant supply and control system including a controller configured to control the flow of fuel gas. In the embodiment of FIG. 10, the controller preferably provides an overall target rate of fuel gas for combustion in the passage 303, and includes the entire overall target rate of fuel gas in the streams at the injectors 306. The controller also preferably limits each stream of injected fuel gas to an amount of fuel that obtains a peak reaction temperature in the passage 303 of not greater than 2,800 degrees F., and further to an amount of fuel that is fully combusted in the passage 303 before mixing with any of the other injected fuel streams. Diluants can be included as described above.

The injectors 306 of FIG. 10 are oriented to inject the streams of fuel gas into the passage 303 along respective axes 309 that converge toward the central axis 305. Moreover, the injectors 306 are located in the same plane, and are spaced apart from each other circumferentially about the central axis 305. The spacing of the injectors 306 helps to maintain the peak flame temperature at or below 2,800 degrees F. by allowing the surrounding air to absorb energy of combustion from the injected fuel streams. A conical configuration of the fuel streams, as indicated schematically in FIG. 10, also contributes to complete combustion of the fuel in each stream separately from combustion of the fuel in each other stream. This is because a conical fuel stream differs from a more cylindrical stream by having a larger ratio of surface area to volume, which enlarges the interface at which the fuel stream mixes with the surrounding draft. An injection pressure of 15 psi or more also contributes to rapid and thorough mixing.

Figure 12:
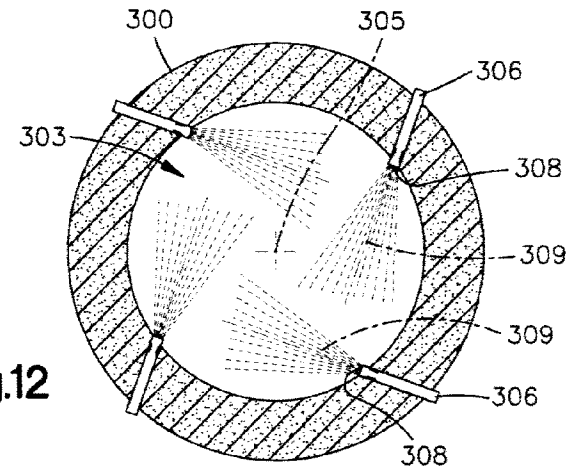
FIGS. 10-22 show other alternative embodiments of an indurating furnace with elements of the present invention.
Figure 13:
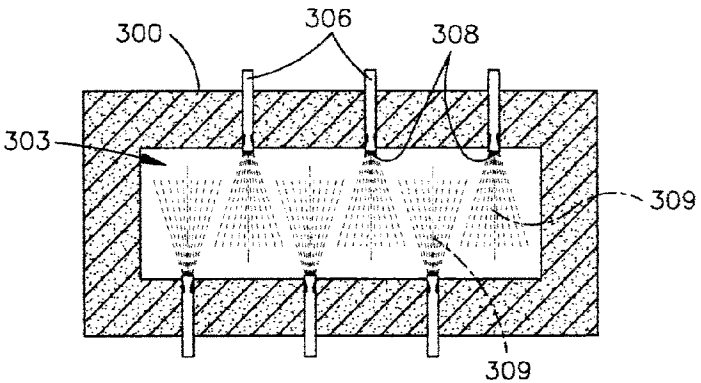
Figure 11:
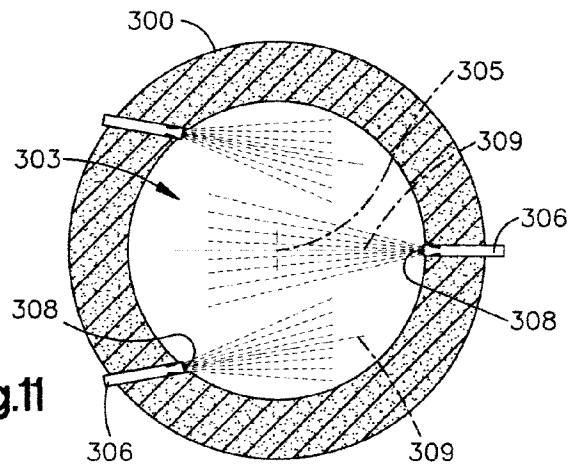

The embodiments of FIGS. 11 and 12 are similar to the embodiment of FIG. 10, as indicated by the use of the same reference numbers for corresponding parts, but differ by injecting the multiple fuel streams along axes 309 that do not intersect in the passage 303. This helps to ensure complete combustion of the fuel in each stream separately from combustion of the fuel in any other stream. FIG. 13 differs by showing an indurating furnace wall structure 300 defining a rectangular passage 303 for conveying a preheated recirculation air draft to a heating station.

Figure 14:
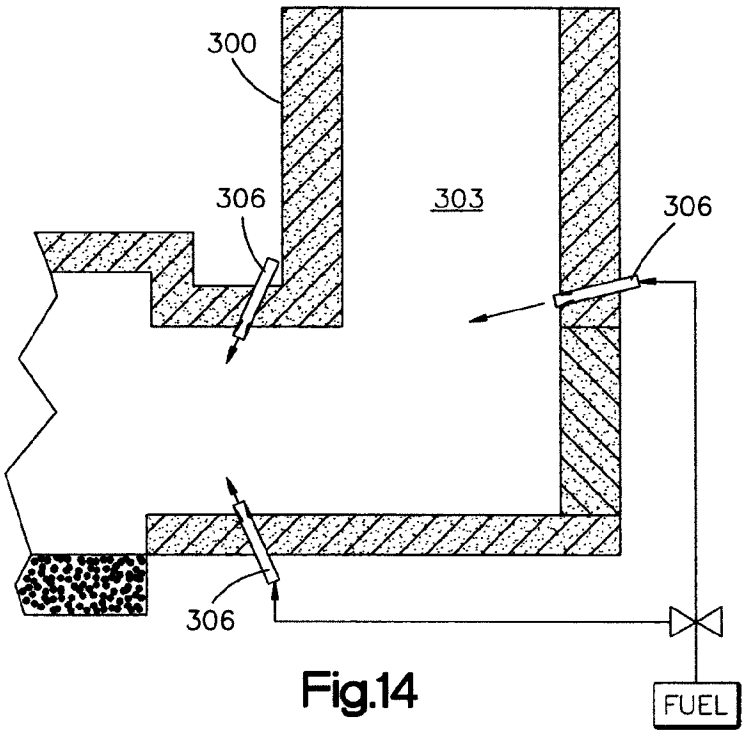

Although the injectors 306 in each of FIGS. 10-13 are arranged in a common plane, any one or more of the injectors 306 can be located downstream of any one or more of the other injectors 306, and each injector 306 may be inclined to inject the stream of fuel gas into the respective passage 303 in a downstream direction. For example, FIG. 14 schematically illustrates injectors 306 inclined in downstream directions, including an array of injectors 306 located downstream of a single upstream injector 306.

Figure 15:
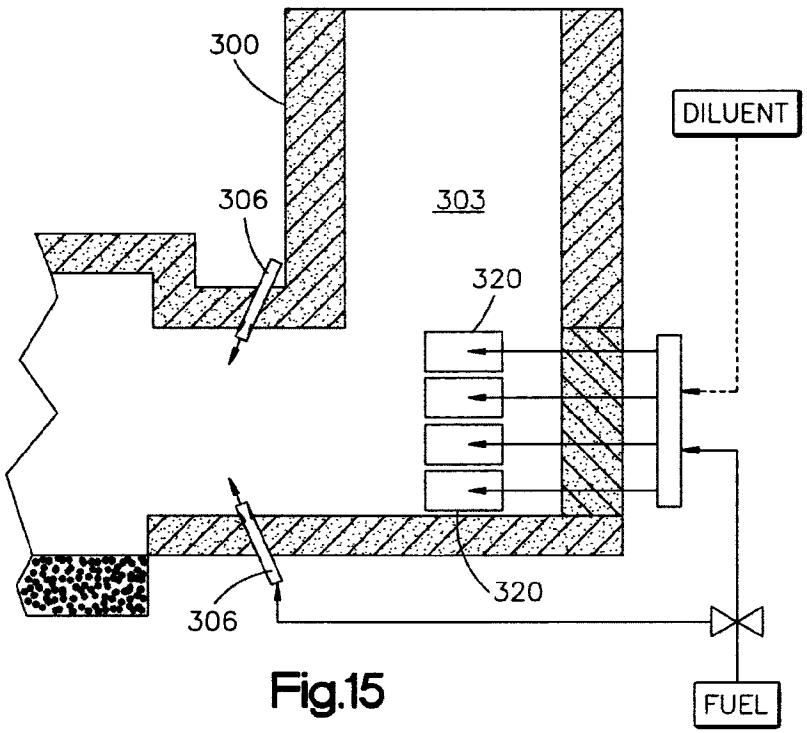

The embodiment of FIG. 15 includes stabilizing structures 320. These structures 320 serve as mixer tubes for streams of injected fuel gas to mix with the draft of preheated recirculation air in the passage 303. The stabilizing structures 320 could be cylinders made from silicon carbide, or refractory baffles with cylindrical openings to provide a structure to enhance mixing and flame stability, and are preferably arranged in a rectangular, honeycomb, or circular array.

Figure 16:
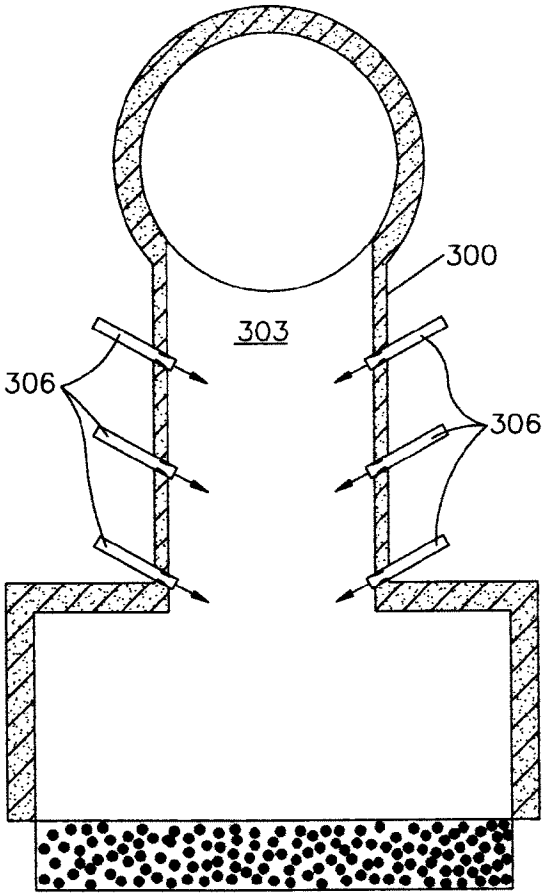
Figure 18:
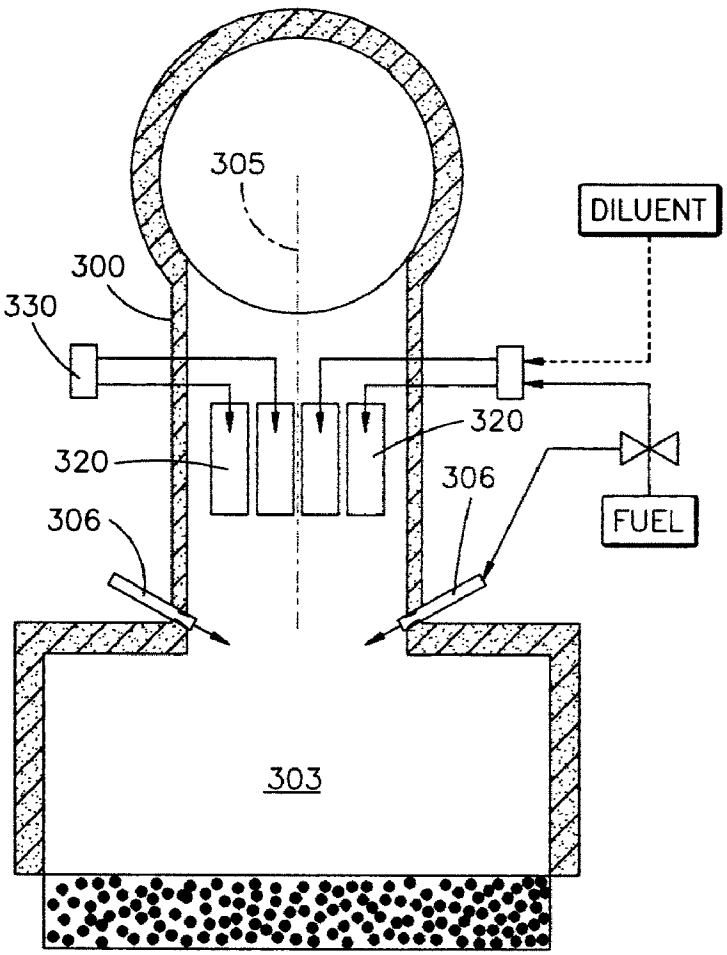

FIG. 16 shows fuel injectors 306 arranged in a plurality of circular arrays that are spaced apart along the length or depth of the passage 303. Any one of these injector arrays could be replaced with a ring manifold for radial high pressure fuel injection to further enhance mixing of the injected fuel gas with the preheated recirculation air in the passage 303.

Figure 17:
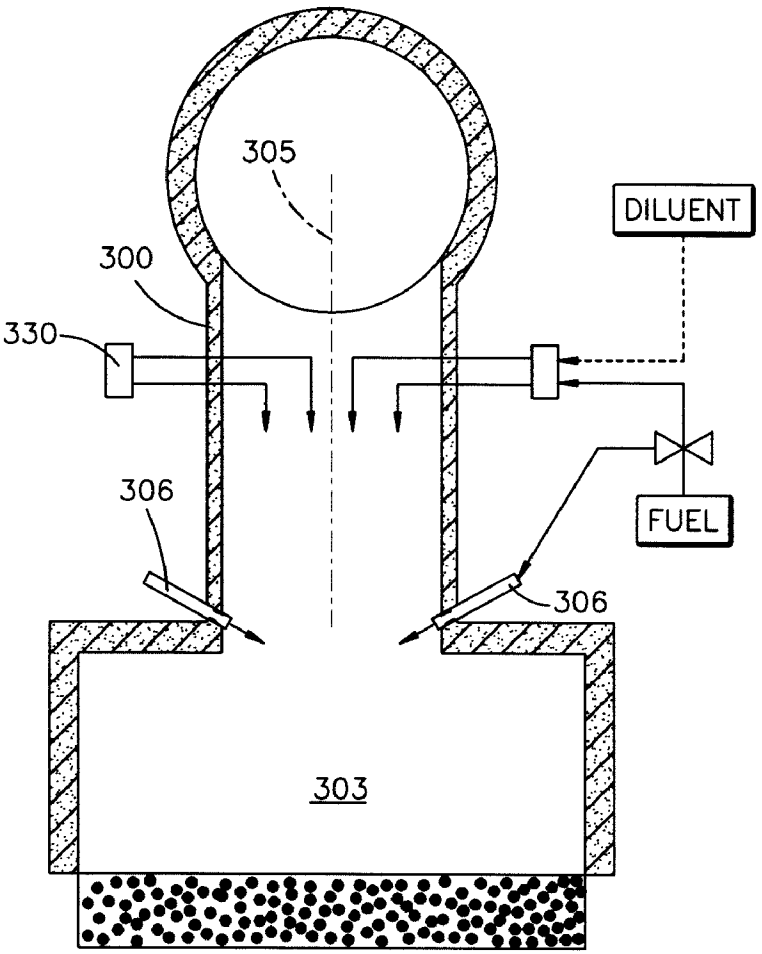

FIG. 17 schematically illustrates a header 330 in which fuel gas is mixed with diluent fluid, and from which streams of the fuel gas-diluent mixture are injected into the passage 303 in directions extending axially along the length or depth of the passage 303. The embodiment of FIG. 18 adds an array of stabilizing structures 320. The embodiment of FIG. 19 adds a header 334 from which diluent fluid is injected in annular streams surrounding the fuel streams injected from the header 330. Diluent fluid could alternatively be injected from an atomizer.

Figure 20:
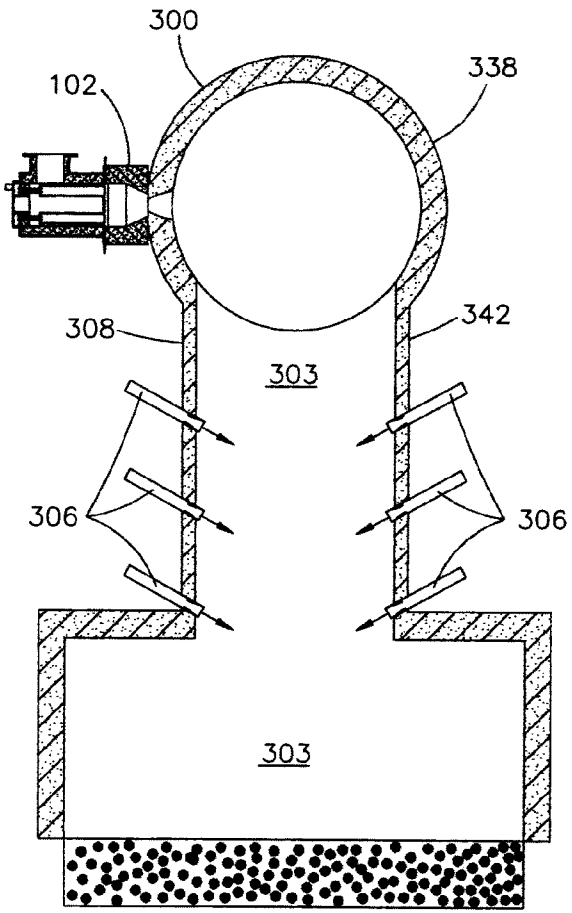
Figure 19:
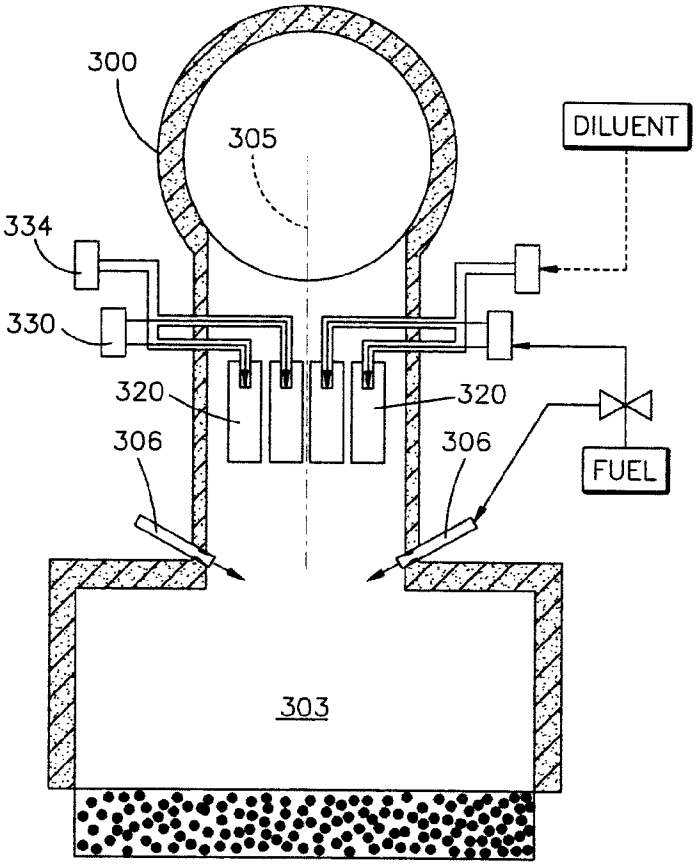
Figure 22:
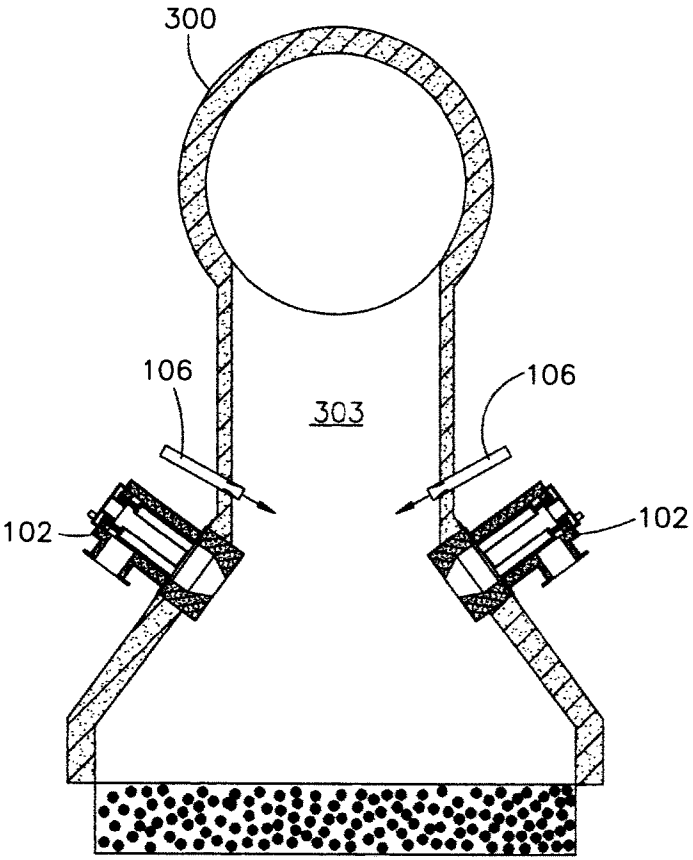
Figure 21:
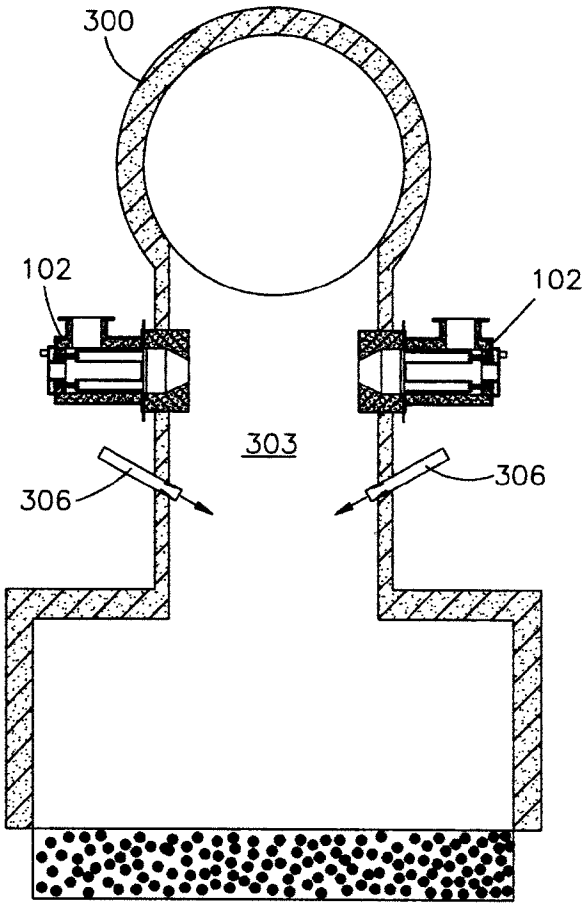

The embodiment of FIG. 20 is similar to the embodiment of FIG. 16, but adds a premix burner 102. The premix burner 102 is located in an upper manifold portion 338 of the indurating furnace wall structure 300 which is located above a downcomer portion 342. The premix burner 102 could be operated as described above regarding the embodiments of FIGS. 3-9, or only in a startup mode to bring the draft of recirculation air up to the auto-ignition temperature, at which time the overall target rate of fuel injection would be shifted entirely to the injectors 306. FIGS. 21 and 22 show other alternative arrangements of premix burners 102 and injectors 106.

This written description sets forth the best mode of carrying out the invention, and describes the invention so as to enable a person skilled in the art to make and use the invention, by presenting examples of elements recited in the claims. The patentable scope of the invention is defined by the claims, and may include other examples that occur to those skilled in the art. Such other examples, which may be available either before or after the application filing date, are intended to be within the scope of the claims if they have elements that do not differ from the literal language of the claims, or if they have equivalent elements with insubstantial differences from the literal language of the claims.

The invention claimed is:

1. A method comprising:

conveying pelletized material through an indurating furnace having a heating station and a passage configured to direct a draft of preheated recirculation air to the heating station;

driving the draft of preheated recirculation air at an elevated temperature through the passage toward the heating station; and providing fuel gas having an auto-ignition temperature below the elevated temperature, and injecting the fuel gas into the draft of preheated recirculation air in the passage in a stream that does not form a combustible mixture before entering the passage thereby forming a combustible mixture of the preheated recirculation air and the fuel gas that ignites in the passage.

2. A method as defined in claim 1 wherein the stream is limited to an amount of fuel that obtains a peak reaction temperature in the passage of not greater than 2800 degrees F.

3. A method as defined in claim 1 wherein the stream is injected into the passage at 15 or more psi.

4. A method as defined in claim 1 wherein the stream is injected into the passage from a pressure recovering nozzle.

5. A method as defined in claim 1 wherein the stream consists of fuel gas.

6. A method as defined in claim 1 the stream includes diluent fluid.

7. A method as defined in claim 6 wherein the diluent fluid comprises flue gas recirculated from the heating station.

8. A method as defined in claim 6 wherein the diluent fluid comprises steam.

9. A method as defined in claim 6 wherein the diluent fluid comprises air.

10. A method as defined in claim 1 wherein an overall target rate of fuel gas is provided for combustion in the passage, and the overall target rate of fuel gas is injected into the passage in one or more streams that do not form a combustible mixture before entering the passage.

11. A method as defined in claim 1 wherein an overall target rate of fuel gas is provided for combustion in the passage, a major portion of the overall target rate of fuel gas is injected into the passage in one or more streams that do not form a combustible mixture before entering the passage, and the remainder of the overall target rate of fuel gas is injected into the passage in a stream that forms a combustible mixture before entering the passage.

12. A method as defined in claim 11 wherein the remainder of the overall target rate of fuel gas is injected into the passage in lean air/fuel gas premix.

13. A method as defined in claim 1 further comprising the step of projecting a flame from a burner outlet port into the passage, and wherein the stream is injected into the passage at a location spaced from the burner outlet port.

14. A method as defined in claim 13 wherein the stream is injected into the passage at a location spaced downstream from the burner outlet port.

15. A method as defined in claim 13 wherein the stream is injected into the passage at a location spaced upstream from the burner outlet port.

16. A method comprising:

conveying pelletized material through an indurating furnace having a heating station and a passage configured to convey a draft of preheated recirculation air to the heating station;

driving the draft of preheated recirculation air at an elevated temperature through the passage toward the heating station; and providing fuel gas having an auto-ignition temperature below the elevated temperature, and injecting the fuel gas into the draft of preheated recirculation air in the passage in multiple streams, each of which does not form a combustible mixture before entering the passage thereby forming a combustible mixture of the preheated recirculation air and the fuel gas that ignites in the passage.

17. A method as defined in claim 16 wherein the multiple streams are injected into the passage from injectors along respective axes that converge toward the center of the passage.

18. A method as defined in claim 16 wherein the multiple streams are injected into the passage from injectors along respective axes that do not intersect in the passage.

19. A method as defined in claim 16 wherein the multiple streams includes a stream that is injected into the passage at a location downstream, relative to the draft of preheated recirculation air, from another of the multiple streams.

20. A method as defined in claim 16 wherein one or more of the multiple streams is limited to an amount of fuel that is fully combusted in the passage before mixing with uncombusted fuel from any other of the multiple streams.

21. A method as defined in claim 16 further comprising the step of projecting a flame from a burner outlet port into the passage, and wherein the multiple streams are injected into the passage at locations spaced from the burner outlet port.

22. A method as defined in claim 21 wherein all of the multiple streams are injected into the passage at locations spaced downstream from the burner outlet port.

23. A method as defined in claim 21 wherein the multiple streams are injected into the passage at locations spaced upstream from the burner outlet port.

* * * * *